US006990993B2

(12) United States Patent
Hafner et al.

(10) Patent No.: US 6,990,993 B2
(45) Date of Patent: Jan. 31, 2006

(54) VACUUM DRAINAGE SYSTEM

(75) Inventors: Volker W. Hafner, Whittier, CA (US); Thomas K. Zinn, Chino, CA (US); Enrique P. Loreto, Fullerton, CA (US)

(73) Assignee: Acorn Engineering Company, City of Industry, CA (US)

( * ) Notice: Subject to any disclaimer, the term of this patent is extended or adjusted under 35 U.S.C. 154(b) by 0 days.

(21) Appl. No.: 10/679,742

(22) Filed: Oct. 6, 2003

(65) Prior Publication Data

US 2005/0072468 A1 Apr. 7, 2005

(51) Int. Cl.
*F04F 3/00* (2006.01)

(52) U.S. Cl. ..... 137/12; 137/205

(58) Field of Classification Search ..... 137/12, 137/205

See application file for complete search history.

(56) References Cited

U.S. PATENT DOCUMENTS 3,853,138 A 12/1974 Amren
4,209,034 A 6/1980 Michael
4,285,359 A 8/1981 Doherty
4,333,487 A 6/1982 Michael
4,333,830 A 6/1982 Michael
4,370,227 A 1/1983 Michael
4,603,709 A 8/1986 Huisma
4,791,949 A 12/1988 Tank
5,575,304 A 11/1996 Hassett
5,673,723 A 10/1997 Roediger
6,305,403 B1 10/2001 von Palffy et al.
6,311,718 B1 11/2001 Hafner et al.
6,467,497 B1 10/2002 Stradinger et al.

FOREIGN PATENT DOCUMENTS

GB 1 579 389 11/1980

*Primary Examiner*—Kevin Lee
(74) *Attorney, Agent, or Firm*—Michael Best & Friedrich LLP

(57) ABSTRACT

A vacuum drainage system operable to remove waste from a source. The system includes an accumulator in fluid communication with the source and a substantially vertical riser having a first portion in fluid communication with the accumulator and a second portion downstream of the first portion and in fluid communication with a vacuum source. A first valve is disposed between the first portion and the second portion. The first valve is selectively operable to provide fluid communication between the first portion and the vacuum source. An air inlet is disposed a distance downstream of the first valve and is selectively operable to provide fluid communication between the outside atmosphere and the second portion.

41 Claims, 4 Drawing Sheets

VACUUM DRAINAGE SYSTEM

BACKGROUND

The present invention relates to a system and method for draining waste in a plumbing system. More particularly, the present invention relates to a system and method for draining waste in a plumbing system using a vacuum system.

Various types of drainage systems are used to direct waste from a source, or a plurality of sources, to a common collection point. For example, gravity feed systems are commonly used in residential and commercial buildings to direct waste to the desired collection point. In a gravity feed system, gravity provides the motive force to move the waste from the source(s) to the collection point. Because gravity is the main motive force, the pipes between the source(s) and the collection point must slope down toward the collection point to maintain the desired flow. However, as the pipes of a gravity system become worn, corroded, roughened, or clogged, gravity alone is sometimes insufficient to move the waste. The requirement that the pipes slope also requires careful planing prior to, and during the construction of a building to assure that the pipes are properly located. This extensive pre-planning makes the addition of pipes or new sources to a completed building difficult.

Vacuum drainage systems offer an alternative to gravity systems. Vacuum systems use a combination of gravity and vacuum to draw waste from the source, or sources, to a collection point. Because the main motive force is vacuum (pressure) rather than gravity, the orientation of the pipes is not significant to the operation of the unit. However, vacuum drainage systems are limited in the height to which they can lift waste and are susceptible to staling during operation.

SUMMARY

The present invention provides a vacuum drainage system operable to remove waste from a source. The system includes an accumulator in fluid communication with the source and a substantially vertical riser having a first portion in fluid communication with the accumulator and a second portion downstream of the first portion and in fluid communication with a vacuum source. A first valve is disposed between the first portion and the second portion. The first valve is selectively operable to provide fluid communication between the first portion and the vacuum source. An air inlet is disposed a distance downstream of the first valve and is selectively operable to provide fluid communication between the outside atmosphere and the second portion.

The invention also provides a vacuum drainage system comprising a source of waste and an accumulator in fluid communication with the source and positioned below the source to receive the waste. A vacuum source is operable to provide a vacuum region. The invention also includes a riser having a first portion in fluid communication with the accumulator and a second portion in fluid communication with the vacuum region. A sensor is operable to measure a waste level within the accumulator and an air inlet is operable in response to the waste level within the accumulator to provide fluid communication between the outside atmosphere and the second portion. A first valve is disposed between the first portion and the second portion. The first valve is movable between a first configuration and a second configuration. The first configuration inhibits fluid communication between the first portion and the second portion and the second configuration allows fluid communication between the first portion and the second portion.

The invention also provides a method of transferring waste using a vacuum drainage system. The vacuum drainage system includes an accumulator that receives waste from a source and a riser having a first portion in fluid communication with the accumulator and a second portion in fluid communication with a vacuum source. The method comprises positioning a valve between the first portion and the second portion and providing a selective air flow path between the atmosphere and the second portion. The method also includes sensing a waste level within the accumulator and opening the valve when the waste level exceeds a first predetermined value. The method further includes opening the air flow path to admit air into the second portion of the riser.

In yet another aspect, the invention provides a vacuum drainage system including a vacuum source operable to provide a vacuum region and an accumulator operable to receive a quantity of waste from at least one source. A first riser portion is in fluid communication with the accumulator and a last riser portion is in fluid communication with the vacuum region. An intermediate riser portion is disposed between the first riser portion and the last riser portion and a first valve interconnects the first riser portion and the intermediate riser portion. The first valve is selectively operable to provide fluid communication between the first riser portion and the intermediate riser portion. A first air inlet is selectively operable to provide fluid communication between the outside atmosphere and the intermediate riser portion and a second air inlet is selectively operable to provide fluid communication between the outside atmosphere and the last riser portion.

BRIEF DESCRIPTION OF THE DRAWINGS

The description particularly refers to the accompanying figures in which.

Before any embodiments of the invention are explained, it is to be understood that the invention is not limited in its application to the details of construction and the arrangements of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof is meant to encompass the items listed thereafter and equivalence thereof as well as additional items. The terms "connected," "coupled," and "mounted" and variations thereof are used broadly and encompass direct and indirect connections, couplings, and mountings. In addition, the terms "connected" and "coupled" and variations thereof are not restricted to physical or mechanical connections or couplings.

DETAILED DESCRIPTION

Figure 1:
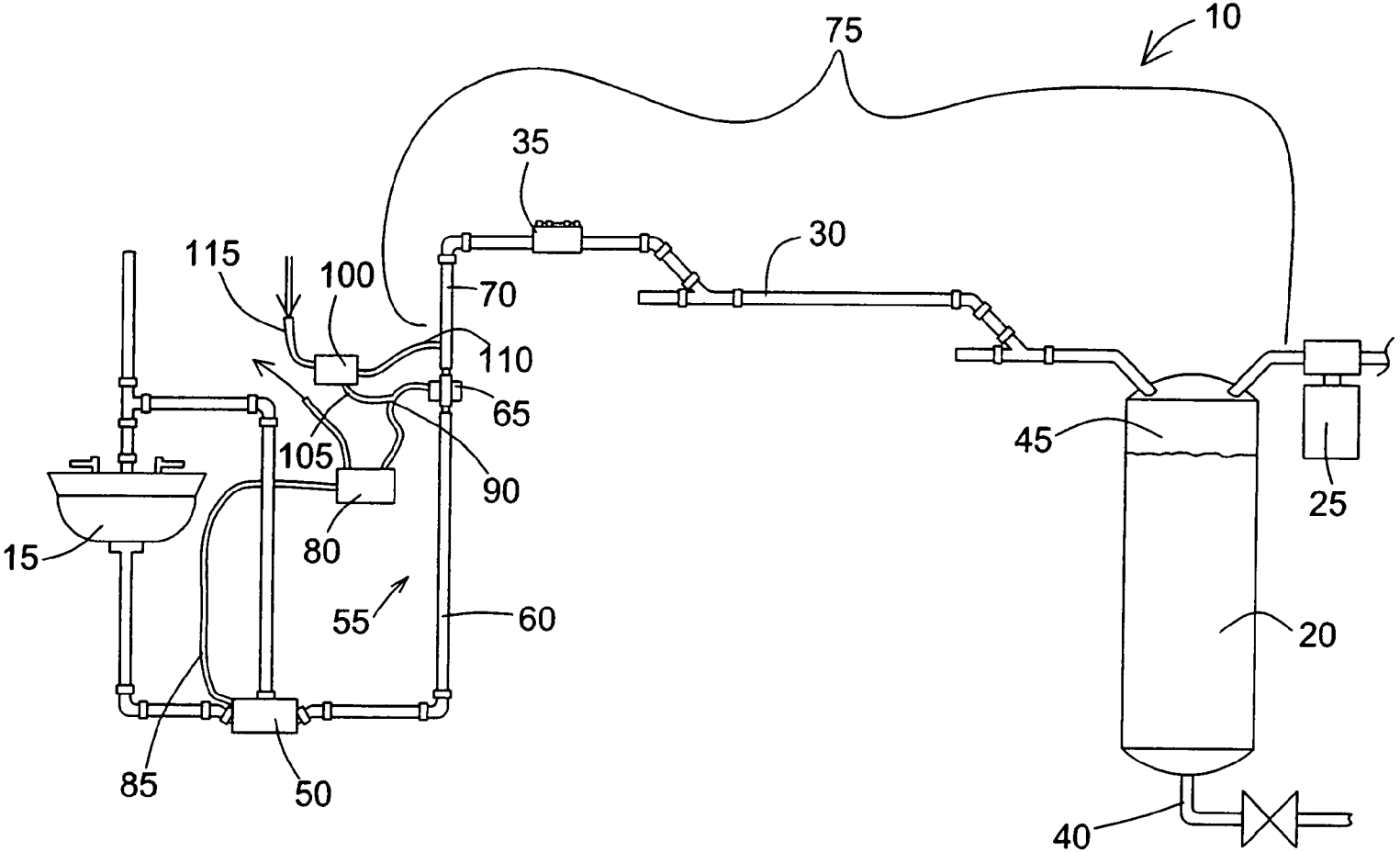
FIG. 1 is a diagrammatic view of a portion of a vacuum drainage system embodying the present invention and including a source and vacuum collection tank.

With reference to FIG. 1, a portion of a vacuum drainage system 10 is illustrated. The system 10 includes a waste source in the form of a sink 15, a collection tank 20, a vacuum pump 25, and a plurality of pipes 30 and fixtures 35 (such as swing check valves, elbows, unions, tees, and the like). It should be noted that while a single sink 15 is illustrated, the vacuum drainage system 10 is capable of draining waste from several sources. In addition, there is no requirement that sinks alone be the source of waste as other sources (e.g., commodes, urinals, waste tubs, wash machines, dishwashers and the like) are commonly connected to vacuum drainage systems 10.

The collection tank 20 provides a point where the waste can collect. The tank 20 includes a lower drain 40 that allows for the removal of the accumulated waste at periodic intervals or whenever the tank 20 is full. The waste enters the tank near the top where a low-pressure air space 45 is maintained. The vacuum pump 25 also connects to the tank 20 near the top so that operation of the vacuum pump 25 at least partially evacuates the air in the low-pressure air space 45 of the tank 20. The evacuation of air in the low-pressure air space 45 acts to reduce the pressure within the tank 20 and draws air in from the piping 30 attached to the tank 20. In this manner, the vacuum pump 25 is able to produce at least a partial vacuum within a portion of the piping 30 and 70 of the vacuum drainage system 10. It should be noted that the terms "low-pressure" and "vacuum" are used interchangeably herein to describe a region having a pressure below the local atmospheric pressure. Thus, the term "low-pressure" should be understood to mean a region having a pressure below atmospheric pressure. In addition, the term "vacuum" should be understood to include partial vacuums (i.e., any pressure below atmospheric).

An accumulator 50 is in fluid communication with the sink 15 to receive a flow of waste. While a single accumulator 50 is illustrated as being associated with a single sink 15, it should be understood that multiple accumulators could be associated with each source or multiple sources could feed a single accumulator. Waste from the sink 15 flows under the force of gravity to the accumulator 50 where it collects. The accumulator 50 provides a small storage area for waste, thereby allowing for the collection of a larger amount of waste and a longer duration between vacuum applications.

Figure 2:
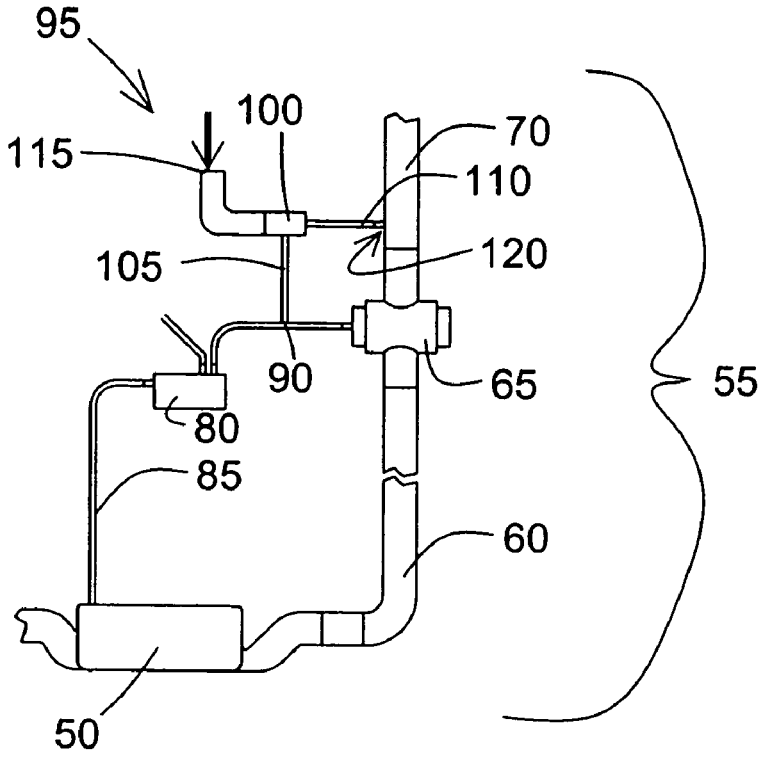
FIG. 2 is a diagrammatic view of a portion of the vacuum drainage system including an aeration system.
Figure 3:
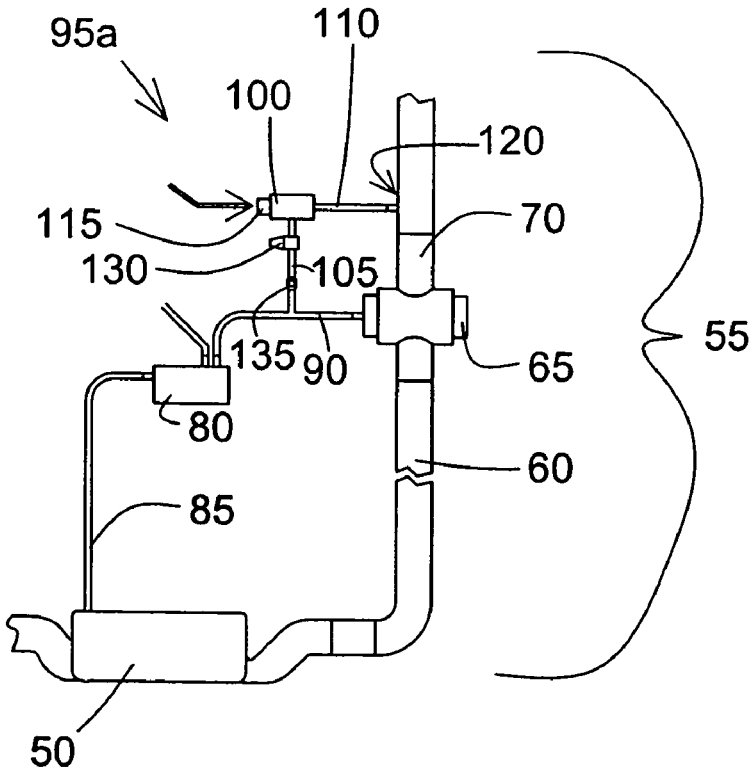
FIG. 3 is a diagrammatic view of a portion of the vacuum drainage system including another aeration system with adjustable aeration timing.

As shown in FIGS. 2 and 3, a riser 55 interconnects the accumulator 50 and the portion of the piping 30 (shown in FIG. 1) in the system that is subjected to the partial vacuum. The riser 55 includes a first portion 60 that attaches to the accumulator 50 and a riser valve 65 connected to the first portion 60. The riser valve 65 separates the first portion 60 from a second portion 70. The second portion 70 is in fluid communication with the portion of the piping system subjected to a partial vacuum. Thus, the riser valve 65 separates a vacuum portion of the piping 75 from the accumulator 50.

As illustrated in FIGS. 1–3, the riser 55 is a substantially vertical pipe arrangement. However, it should be understood that there is no requirement that the riser 55 be oriented vertically or that the riser 55 actually change in elevation. The riser length and orientation is largely a function of the location of the source relative to the collection tank 20.

The position of the riser valve 65 relative to the accumulator 50 can effect system operation. Therefore, it is desirable to locate the riser valve no more than four feet above the elevation of the accumulator 50, with lower locations being more preferred. However, it should be understood that many other factors (e.g., pipe diameter, piping arrangement, vacuum pressure, atmospheric pressure, etc.) can effect system performance and will allow systems to function with riser valves 65 located at elevations greater than four feet above the accumulator 50.

As illustrated in FIGS. 2 and 3, a controller 80 operates the riser valve 65 to facilitate the removal of the waste collected within the accumulator 50. One possible controller 80 is similar to the controller 80 described in U.S. Pat. No. 6,311,718 the entire contents of which are incorporated herein by reference. Other types of controllers, such as solenoid-operated actuators, will also function with the present invention. In fact, the actual arrangement of the controller is not critical to the function of the present invention. The controller 80 includes a first tube 85 that provides fluid communication between the accumulator 50 and the controller 80 and a second tube 90 that provides fluid communication between the controller 80 and the riser valve 65.

The first tube 85 has an open end positioned within the accumulator 50 such that as the accumulator 50 fills, the end of the tube 85 becomes submerged. Once submerged, the end of the tube 85 is subjected to hydrostatic pressure that varies with the depth of the liquid within the accumulator 50. Thus, the tube 85 is able to measure a pressure change within the accumulator 50 even though the accumulator 50 is exposed to atmospheric pressure.

With reference to FIG. 2, the vacuum drainage system 10 also includes an aeration system 95 connected in a manner that allows for the admission of air downstream (on the vacuum side) of the riser valve 65. The aeration system 95 includes an air admittance valve 100 having a tube 105 connected to the second tube 90 and an air tube 110 connected to the second portion 70 of the riser 55. The tube 105 can be formed from any suitable material so long as it can provide fluid communication between the second tube 90 and the air admittance valve 100. The fluid communication allows the vacuum pressure within the second tube 90 to be used to actuate the air admittance valve 100. Thus, when the pressure within the second tube 90 reaches a predetermined value (either rises above or falls below depending on the arrangement of the controller 80), the air admittance valve 100 opens. Many types of air admittance valves 100 will function with the present invention. Thus, while a vacuum pressure-actuated valve is described herein, the invention should not be limited to vacuum pressure-actuated valves alone.

When the air admittance valve 100 is open, air is drawn through an air inlet 115, through the air tube 110, and into the second portion 70 of the riser 55, which is maintained under a partial vacuum by the vacuum pump 25. Thus, the air tube 110 should be formed from a material that is suited to the purpose (e.g., metals, such as copper, steel, stainless steel, or plastics, rubber, composites, ceramics, and the like).

The location in the second portion 70 of the riser 55 at which the air tube 110 penetrates the riser 55 (i.e., the aeration point 120) is not critical. However, it is desirable to position the aeration point 120 as near to the riser valve 65 as possible without interfering with the function of the riser valve 65. A position between 1 inch and 12 inches downstream of the riser valve 65 is preferred.

Turning to FIG. 3, another embodiment of an aeration system 95*a* is illustrated. The system of FIG. 3 is similar to that of FIG. 2 with the addition of a timer 130 and a check valve 135. Any common timer 130 and check valve 135 can be used with the present system 10 to achieve the desired functionality. For example, a timer that begins a timing cycle when the air admittance valve 100 and riser valve 65 open and times out after a predetermined period of time passes following the closure of the riser valve 65 is well suited to the purpose. Until the timer 130 times out, the air admittance valve 100 remains in the open position. Once the timer 130 times out, the pressure within the second tube 90 reaches the air admittance valve 100 and causes it to close. Both the timer 130 and the check valve 135 are positioned in the pressure tube 105 and provide additional functionality that will be described in conjunction with the overall system function.

Figure 5:
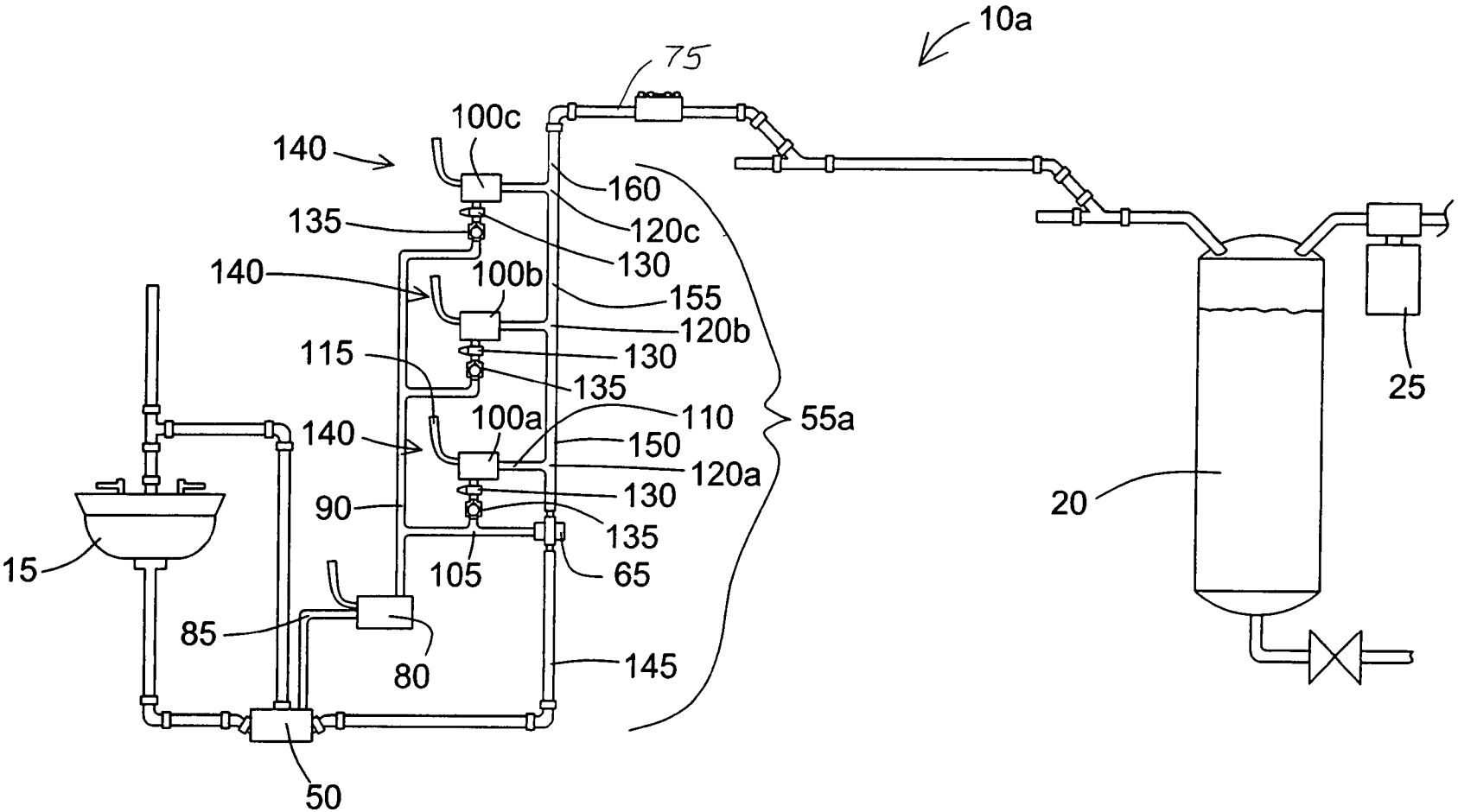
FIG. 5 is a diagrammatic view of a portion of another vacuum drainage system including multiple aeration stages.

FIG. 5 illustrates another construction of a vacuum drainage system 10*a* that includes several aeration stages 140. The system 10*a* includes the source such as one or more sinks 15 that feeds waste to one or more accumulators 50 as was described with regard to FIG. 1. In addition, the system 10*a* includes a controller 80 similar to the one described with regard to FIGS. 1–3. The controller 80 operates in much the same manner as was described above. However, in the construction of FIG. 5, the controller 80 operates to actuate three air admittance valves, 100*a*, 100*b*, and 100*c* that admit air at three air admittance points 120*a*, 120*b*, and 120*c*.

The riser 55*a* includes a first portion 145, a second portion 150, a third portion 155, and a fourth portion 160. The first portion 145 is in fluid communication with the accumulator 50 and is separated from the second portion 150 by the riser valve 65. The second portion 150 is separated from the third portion 155 by the second air admittance point 120*b*. The third portion 160 is separated from the fourth portion 165 by the third air admittance point 120*c*. The fourth portion 165 is in fluid communication with the vacuum portion of the piping 75. It should be noted that in many constructions, the second portion 150, the third portion 155, and the fourth portion 160 are formed from a single pipe. The air admittance points 120 define the break between the portions 155, 160, 165. However, the portions 155, 160, 165 are still formed from a single pipe and, in most constructions, cannot be "separated" from one another.

The aeration points 120*a*, 120*b*, 120*c* receive a flow of air from the independent air admittance valves 100*a*, 100*b*, 100*c*. Each air admittance valve 100*a*, 100*b*, 100*c* is actuated in response to the pressure within the second tube 90 as described with regard to FIGS. 1–3. The use of multiple air admittance points 120*a*, 120*b*, and 120*c* can improve the aeration of the waste as the waste travels to the tank 20.

While the aeration stages 140 of FIG. 5 are arranged as illustrated in FIG. 3 to include a check valve 135 and a timer 130 in each stage, other constructions may employ the arrangement of FIG. 2. In addition, different combinations or arrangements may be used as required by the system design. Furthermore, multiple controllers 80 or multiple riser valves 65 could be used if desired. For example, one possible system includes a controller 80 for each aeration stage 140. As one of ordinary skill will realize, many combinations of valves 80, 100 will function with the present system.

Figure 4:
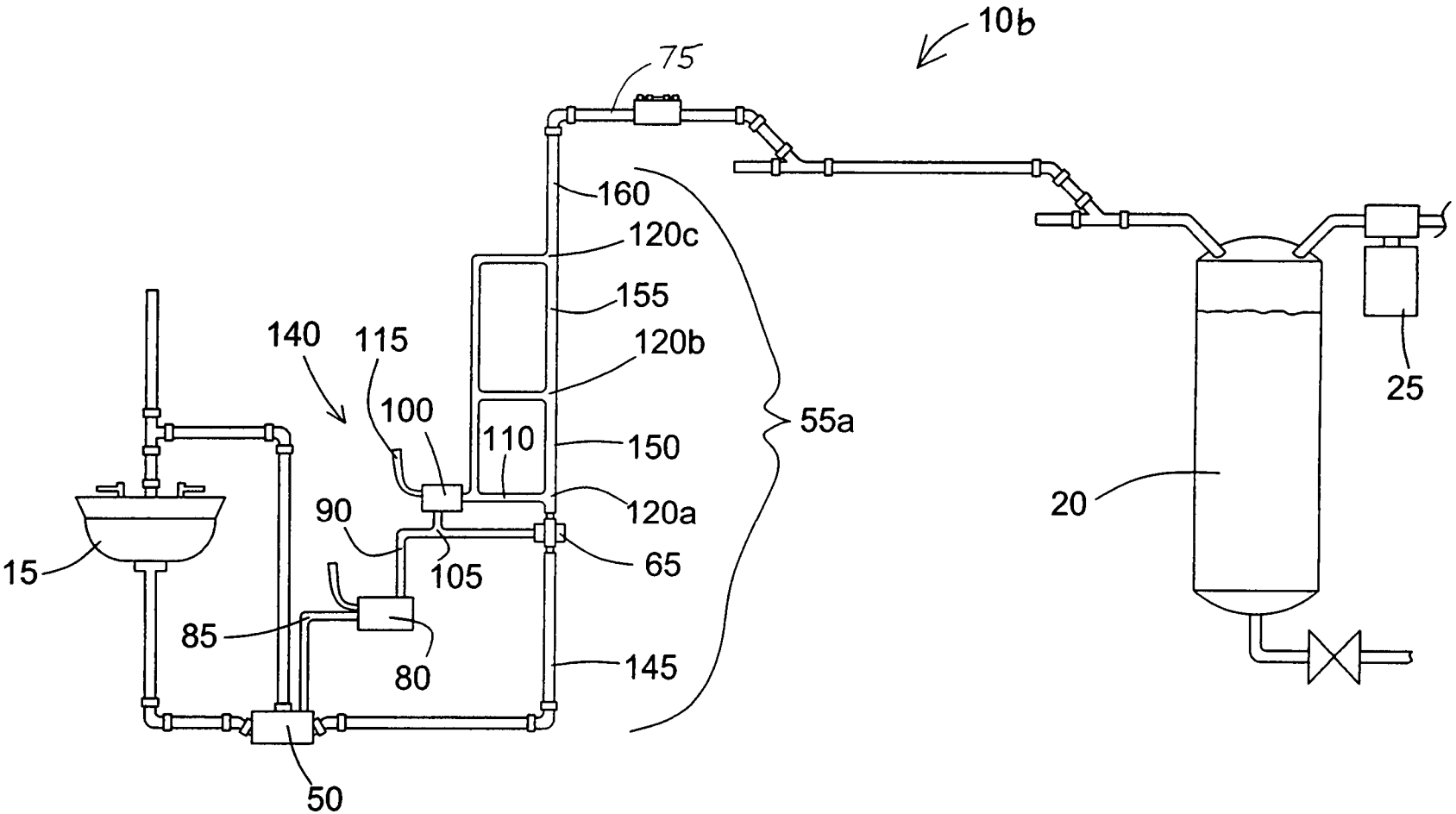
FIG. 4 is a diagrammatic view of a portion of a vacuum drainage system including multiple aeration stages.

In another construction illustrated in FIG. 4, the system 10*b* includes a single air admittance valve 100 that feeds multiple air admittance points 120. In this construction, the controller 80 actuates the air admittance valve 100 to admit air to three air admittance points 120*a*, 120*b*, and 120*c*. As with previous constructions, the aeration station 140 could include a check valve 135 and a timer 130 if desired.

FIGS. 4 and 5 illustrates systems 10*a*, 10*b* having three aeration stages 140. It should be understood that fewer aeration stages 140 could be used or more aeration stages 140 could be used as desired. There is no limit to the quantity of aeration stages 140 used with the present invention.

With reference to FIGS. 1 and 2, the operation of the vacuum drainage system 10 will now be described. Following use of the sink 15, waste drains into the accumulator 50 (with gravity as the motive force). With continued or numerous uses, the waste level within the accumulator 50 rises. Once the end of the tube 85 is submerged, the hydrostatic pressure the tube 85 is subjected to varies with the liquid level within the accumulator 50. Thus, as the waste level rises, the pressure within the first tube 85 between the controller 80 and the accumulator 50 increases. At a predetermined pressure, corresponding to a particular waste level within the accumulator 50, the pressure is sufficient to initiate the controller 80, which in turn actuates and opens both the riser valve 65 and the air admittance valve 100.

With the riser valve 65 now open, the first portion 60 of the riser 55 and the accumulator 50 are in fluid communication with the collection tank 20. As such, the low pressure draws the waste out of the accumulator 50 and the first portion 60 of the riser 55 and moves the waste toward the collection tank 20. At the same time, an amount of air is drawn into the second portion 70 of the riser 55 through the air admittance valve 100. The air serves to break-up the waste into an emulsion (air-waste mix) that is more easily lifted by the vacuum. If the waste stalls with the air-admittance valve 100 open, the air entering the second portion 70 will act to push the waste from the aeration point 120 to the vacuum tank 20 while simultaneously breaking-up the waste.

As the waste is drawn out of the accumulator 50, the waste level within the accumulator 50 drops, thereby causing the pressure within the first tube 85 to drop in a similar fashion. Once the pressure within the first tube 85 reaches a predetermined value, the controller 80 actuates and closes both the riser valve 65 and the air admittance valve 100.

The operation of the construction of FIG. 3 is similar to that of FIG. 2 up to the point at which the valves 65, 100 close. The timer 130 allows the air admittance valve 100 to remain open after the riser valve 65 closes. With the air admittance valve 100 open, the vacuum continues to draw in air through the air admittance valve 100. The timer 130 delays the closure of the air admittance valve 100 for a predetermined length of time. In many constructions, the timer 130 is adjustable to vary the length of time that the air admittance valve 100 remains open after closure of the riser valve 65. The continued admittance of air after the closure of the riser valve 65 serves to reduce the quantity of waste that flows back or remains within the second portion 70 of the riser 55 after the valves 65, 100 close.

The construction of FIG. 4 functions much like the construction of FIG. 1. The exception being that when the air admittance valve 100 opens, air is directed to three aeration points 120*a*, 120*b*, and 120*c* rather than a single aeration point 120.

The construction of FIG. 5 functions in much the same manner as the system 10 of FIG. 1. In one arrangement, all of the air admittance valves 100*a*, 100*b*, 100*c* open and/or close at substantially the same time. This allows for the admittance of air at multiple elevations along the waste column.

In another system, the air admittance valves 100*a*, 100*b*, 100*c* open and/or close in sequence rather than simultaneously. Timers can be employed to achieve the desired time intervals between the opening and closing of the various valves 100*a*, 100*b*, 100*c*. In addition, other control systems (e.g., microprocessor-based controls, PLCs, relay controls and the like) can be used to control the various valves in the system.

Although the invention has been described in detail with reference to certain preferred embodiments, variations and modifications exist within the scope and spirit of the invention as described and defined in the following claims.

What is claimed is:

1. A vacuum drainage system operable to remove waste from a source, the system comprising:

an accumulator in fluid communication with the source;

a substantially vertical riser having a first portion in fluid communication with the accumulator and a second portion downstream of the first portion and in fluid communication with a vacuum source;

a first valve disposed between the first portion and the second portion, the first valve selectively operable to provide fluid communication between the first portion and the vacuum source; and an air inlet disposed a distance downstream of the first valve, the air inlet selectively operable to provide fluid communication between the outside atmosphere and the second portion.

2. The system of claim 1, wherein the air inlet includes a second valve.

3. The system of claim 2, further comprising an actuator operable to initiate actuation of the first valve and the second valve.

4. The system of claim 3, wherein the actuator includes a sensor portion operable to control the actuator.

5. The system of claim 4, wherein the sensor portion includes a liquid level sensor operable to measure the liquid level within the accumulator.

6. The system of claim 4, wherein the sensor portion includes a pressure sensor in fluid communication with the accumulator to sense a pressure within the accumulator.

7. The system of claim 3, wherein the actuator includes a solenoid-operated actuator.

8. The system of claim 3, wherein the actuator is pressure-actuated with a pressure within the accumulator being sufficient to actuate the actuator.

9. The system of claim 2, wherein the first valve and the second valve open and close substantially simultaneously.

10. The system of claim 2, further comprising a timer operable to delay the closure of the second valve relative to the first valve.

11. The system of claim 1, wherein the air inlet is a first air inlet, the system further comprising a second air inlet disposed within the second portion of the riser and spaced a distance downstream of the first air inlet.

12. The system of claim 11, further comprising a third air inlet disposed within the second portion of the riser and spaced a distance downstream of the second air inlet.

13. A vacuum drainage system comprising:

a source of waste;

an accumulator in fluid communication with the source and positioned below the source to receive the waste;

a vacuum source operable to provide a vacuum region;

a riser having a first portion in fluid communication with the accumulator and a second portion in fluid communication with the vacuum region;

a sensor operable to measure a waste level within the accumulator;

an air inlet operable in response to the waste level within the accumulator to provide fluid communication between the outside atmosphere and the second portion; and a first valve disposed between the first portion and the second portion, the first valve movable between a first configuration and a second configuration, wherein the first configuration inhibits fluid communication between the first portion and the second portion and the second configuration allows fluid communication between the first portion and the second portion.

14. The system of claim 13, wherein the vacuum region includes a collection tank.

15. The system of claim 13, wherein the air inlet includes a second valve.

16. The system of claim 15, further comprising an actuator operable to initiate actuation of the first valve and the second valve.

17. The system of claim 16, wherein the actuator includes a sensor portion operable to control the actuator.

18. The system of claim 17, wherein the sensor portion includes a liquid level sensor operable to measure the liquid level within the accumulator.

19. The system of claim 17, wherein the sensor portion includes a pressure sensor in fluid communication with the accumulator to sense a pressure within the accumulator.

20. The system of claim 16, wherein the actuator includes a solenoid-operated actuator.

21. The system of claim 16, wherein the actuator is pressure-actuated with a pressure within the accumulator being sufficient to actuate the actuator.

22. The system of claim 15, wherein the first valve and the second valve actuate substantially simultaneously.

23. The system of claim 15, further comprising a timer operable to delay the closure of the second valve relative to the first valve.

24. The system of claim 13, wherein the air inlet is a first air inlet, the system further comprising a second air inlet disposed within the second portion of the riser and spaced a distance downstream of the first air inlet.

25. The system of claim 24, further comprising a third air inlet disposed within the second portion of the riser and spaced a distance downstream of the second air inlet.

26. The system of claim 13, wherein the first valve moves to the first configuration in response to a waste level below a predetermined level and moves to the second configuration in response to a waste level above a second predetermined value.

27. A method of transferring waste using a vacuum drainage system including an accumulator that receives waste from a source and a riser having a first portion in fluid communication with the accumulator and a second portion in fluid communication with a vacuum source, the method comprising:

positioning a valve between the first portion and the second portion;

providing a selective air flow path between the atmosphere and the second portion;

sensing a waste level within the accumulator;

opening the valve when the waste level exceeds a first predetermined value; and opening the air flow path to admit air into the second portion of the riser.

28. The method of claim 27, further comprising sensing a second waste level within the accumulator and closing the valve and the air flow path in response to the second waste level.

29. The method of claim 27, further comprising sensing a second waste level within the accumulator and closing the valve in response to the second waste level.

30. The method of claim 29, further comprising delaying the closure of the air flow path for a length of time after the closure of the valve and closing the air flow path after the closure of the valve and the passage of the length of time.

31. A vacuum drainage system comprising:

a vacuum source operable to provide a vacuum region;

an accumulator operable to receive a quantity of waste from at least one source;

a first riser portion in fluid communication with the accumulator;

a last riser portion in fluid communication with the vacuum region;

an intermediate riser portion disposed between the first riser portion and the last riser portion;

a first valve interconnecting the first riser portion and the intermediate riser portion, the first valve selectively operable to provide fluid communication between the first riser portion and the intermediate riser portion;

a first air inlet selectively operable to provide fluid communication between the outside atmosphere and the intermediate riser portion; and a second air inlet selectively operable to provide fluid communication between the outside atmosphere and the last riser portion.

32. The vacuum drainage system of claim 31, wherein the first air inlet includes a first inlet valve and the second air inlet includes a second inlet valve.

33. The vacuum drainage system of claim 31, further comprising an air inlet valve operable to operate the first air inlet and the second air inlet.

34. The vacuum drainage system of claim 31, further comprising an actuator operable to initiate actuation of the first valve.

35. The vacuum drainage system of claim 31, further comprising a third air inlet positioned between the first and second air inlet to define a first intermediate riser portion and a second intermediate riser portion.

36. The vacuum drainage system of claim 35, wherein the first air inlet includes a first inlet valve, the second air inlet includes a second inlet valve, and the third air inlet includes a third inlet valve.

37. The vacuum drainage system of claim 36, further comprising a timer operable to delay the closure of one of the first inlet valve, the second inlet valve, and the third inlet valve relative to the other of the first inlet valve, the second inlet valve, and the third inlet valve.

38. The vacuum drainage system of claim 35, further comprising an air inlet valve operable to operate at least two of the first air inlet, the second air inlet, and the third air inlet.

39. A vacuum drainage system operable to remove waste from a source, the system compnsrng:

an accumulator in fluid communication with the source;

a riser having a first portion in fluid communication with the accumulator and a second portion downstream of the first portion and in fluid communication with a vacuum source;

a first valve disposed between the first portion and the second portion;

a second valve in fluid communication with the second portion;

an actuator operable to provide a pressure signal to the first valve and the second valve, the first valve and the second valve opening in response to a first pressure signal and the first valve closing in response to a second pressure signal; and a timer operable in response to the second pressure signal to close the second valve after the passage of a predetermined length of time.

40. The system of claim 39, further comprising a first fluid path disposed between the actuator and the first valve and a second fluid path between the actuator and the second valve, and wherein a check valve and the timer are positioned within the second fluid path.

41. The system of claim 40, wherein the timer is selectively operable to inhibit fluid communication between the actuator and the second valve.

* * * * *